US007892156B2

(12) United States Patent
Marcantonio

(10) Patent No.: US 7,892,156 B2
(45) Date of Patent: Feb. 22, 2011

(54) EXERCISING APPARATUS

(76) Inventor: Richard Marcantonio, 66 N. Broadway, Irvington, NY (US) 10533

( * ) Notice: Subject to any disclaimer, the term of this patent is extended or adjusted under 35 U.S.C. 154(b) by 0 days.

(21) Appl. No.: 12/288,493

(22) Filed: Oct. 21, 2008

(65) Prior Publication Data

US 2009/0048078 A1 Feb. 19, 2009

Related U.S. Application Data

(63) Continuation-in-part of application No. 11/982,911, filed on Nov. 6, 2007, now Pat. No. 7,530,935.

(60) Provisional application No. 60/878,427, filed on Jan. 3, 2007.

(51) Int. Cl.
*A63B 21/05* (2006.01)

(52) U.S. Cl. ..... 482/128; 482/904

(58) Field of Classification Search ..... 482/100–103, 482/904, 121–124, 127–128, 51
See application file for complete search history.

(56) References Cited

U.S. PATENT DOCUMENTS 4,911,425 A * 3/1990 Kynast et al. ..... 482/54
4,936,573 A * 6/1990 Miller ..... 482/118
5,044,629 A * 9/1991 Ryan et al. ..... 482/101
5,048,827 A * 9/1991 Caruso ..... 482/73
5,100,128 A * 3/1992 Mabry et al. ..... 482/134
5,242,179 A * 9/1993 Beddome et al. ..... 280/233
5,643,143 A * 7/1997 Burak et al. ..... 482/54
5,697,628 A * 12/1997 Spear ..... 280/304.1
5,762,593 A * 6/1998 Whiteley ..... 482/134
6,334,624 B1 * 1/2002 Giglio ..... 280/304.1
7,125,365 B2 * 10/2006 Krietzman ..... 482/112

* cited by examiner

*Primary Examiner*—Fenn C Mathew
(74) *Attorney, Agent, or Firm*—Karl F. Milde, Jr.; Eckert Seamans Cherin & Mellott, LLC

(57) ABSTRACT

An exercising apparatus designed to fit around a seat includes a frame that is adapted to be secured to a support. The frame is a U-shaped configuration with a lateral open area to receive the seat into the frame. One or more arms are coupled to the frame about one or more pivots. Further, the pivots allow a pivotal motion of each of the arms when a force is exerted thereto by a user. One or more resistance devices coupled to the frame and the arms, which provide resistance to the pivotal motion of each of the arms. The resistance devices, which may be a hydraulic or pneumatic piston and cylinder, may include a spring to bias the arms toward their initial, upright position.

50 Claims, 14 Drawing Sheets

EXERCISING APPARATUS

CROSS-REFERENCE TO RELATED APPLICATION

The present application is a continuation-in-part of application Ser. No. 11/982,911 filed Nov. 6, 2007, now U.S. Pat. No. 7,530,935 entitled "Exercising Apparatus", which claims priority from U.S. Provisional Application No. 60/878,427, filed Jan. 3, 2007 entitled "Exercise Apparatus".

BACKGROUND OF THE INVENTION

The present invention relates, in general, to an exercising apparatus. More specifically, the present invention relates to an exercising apparatus designed to fit around a seat, such as a toilet seat or a wheelchair.

Various types of exercising apparatus are known in the art that are intended for indoor use. Typically, an exercising apparatus includes a frame standing on a floor on which resistance delivery systems are attached and the resistance delivery systems provide resistance to a force applied by a user. Further, the frame has a seat or a bench attached to it on which the user may sit or lay down depending upon the exercise to be performed.

Conventional exercising apparatus with an attached seat is suitable to use for the intended exercise; however, such an exercising apparatus occupies a relatively large space. Moreover, a separate room or a large area is required for the exercising apparatus. Further, such exercising apparatus does not have provision for a user in a wheelchair or on a toilet seat to exercise without getting up out of the seat.

In light of the foregoing, there is a need for an exercising apparatus that is easy to fit around an existing seat.

SUMMARY OF THE INVENTION

An object of the present invention is to provide an exercising apparatus that is designed to fit around a seat.

Another object of the present invention is to provide an exercising apparatus that is designed to fit around a toilet seat.

Another object of the present invention is to provide an exercising apparatus that is designed to receive a wheelchair.

Embodiments of the present invention provide an exercising apparatus designed to fit around a seat. In one configuration of the apparatus, the seat is a toilet seat. The exercising apparatus includes a frame adapted to be attached to a support through one or more attachment devices. The support may be a wall or a base member or the seat. One or more arms are pivotally coupled to the frame through one or more pivot joints. The pivots allow a pivotal motion of each of the arms when a user exerts a directional force on the arms. The user may sit on the seat and exert the directional force on the arms.

One or more first resistance devices are attached to the frame and the arms. The first resistance devices provide resistance to the pivotal motion. The resistance may be increased or decreased based on the convenience of the user. The exercising apparatus includes one or more handgrip members that are releasably attached to each of the arms. One or more shafts protrude from the arms and are attached to the handgrip members. These shafts extend or retract based on a linear axial movement of the shafts with respect to the arms. The linear axial movement of the shafts provides proper hand positioning of the user during exercise. In addition, the exercising apparatus includes one or more second resistance devices inside the arms, which are attached to the shafts. These second resistance devices provide resistance to the linear axial movement.

In another configuration, the exercising apparatus is designed to receive a wheelchair. This exercising apparatus includes a frame with a U-shaped configuration and a lateral open area to receive the wheelchair into the frame. The frame is mounted on a base and attached to a support. In a particular embodiment, the frame is secured to the base through a base plate. In this embodiment, the base plate receives the wheelchair and is secured in place on the base by the weight of the user.

The present invention concerns various aspects of an exercising apparatus of the aforementioned type. In a first aspect of the invention, means are provided to adjust the resistance applied to the arms, against the directional force applied by the user. As will be explained in detail below, the resistance is adjusted by adjusting the position of a "control point"; that is, the point at which a resistance device is coupled to the arm. This adjustment, which can be easily made by the user by turning a knob, changes the distance of the control point from the pivot point of the arm, thus changing the mechanical advantage of the resistance device.

Another aspect of the invention relates to a locking mechanism for adjustably limiting the range of motion of the arm about their pivot points. In this way, the range of motion can be adjusted to fit the needs of the user, so that the user need not stretch beyond a comfortable limit when exercising with the arms. The locking mechanism may be operated to constrain only one end of the range of motion of an arm about its pivot, or constrain both ends of the range of motion. In a particular embodiment, where the resistance device comprises a hydraulic or pneumatic cylinder with an internal piston, the locking mechanism includes a device, attached to the cylinder, for limiting the motion of the piston within the cylinder.

According to another aspect of the invention, each arm of the exercise device is provided at its end with a handgrip member to be gripped by a user which is moveable to, and lockable at, at least two different positions with respect to the arm. For example, the handgrip member may be rotated about the longitudinal axis of the arm to its most convenient angular position for the user. In a preferred embodiment, the handgrip member may be rotated to a first position directed toward the user or to a second position directed away from the user.

The mechanism for locking and retaining the handgrip member includes two tubes, arranged coaxially and surrounding with the arm and the stem of the handgrip member, respectively, which tubes have mating services for engaging one another and limiting their respective movement.

Still another aspect of the present invention relates to the pivot joint used for each arm of the exercise machine. This pivot joint comprises a casing having a first opening accepting a tubular portion of the arm and a second opening accepting a tubular portion of the frame. An internal rotatable joint is provided between the two portions. This joint has an axle aligned with and extending between the tubular portions of the arm and frame, without intersecting either portion.

For a full understanding of the present invention, reference should now be made to the following detailed description of the preferred embodiments of the invention as illustrated in the accompanying drawings.

DETAILED DESCRIPTION OF THE PREFERRED EMBODIMENTS

Figure 1:
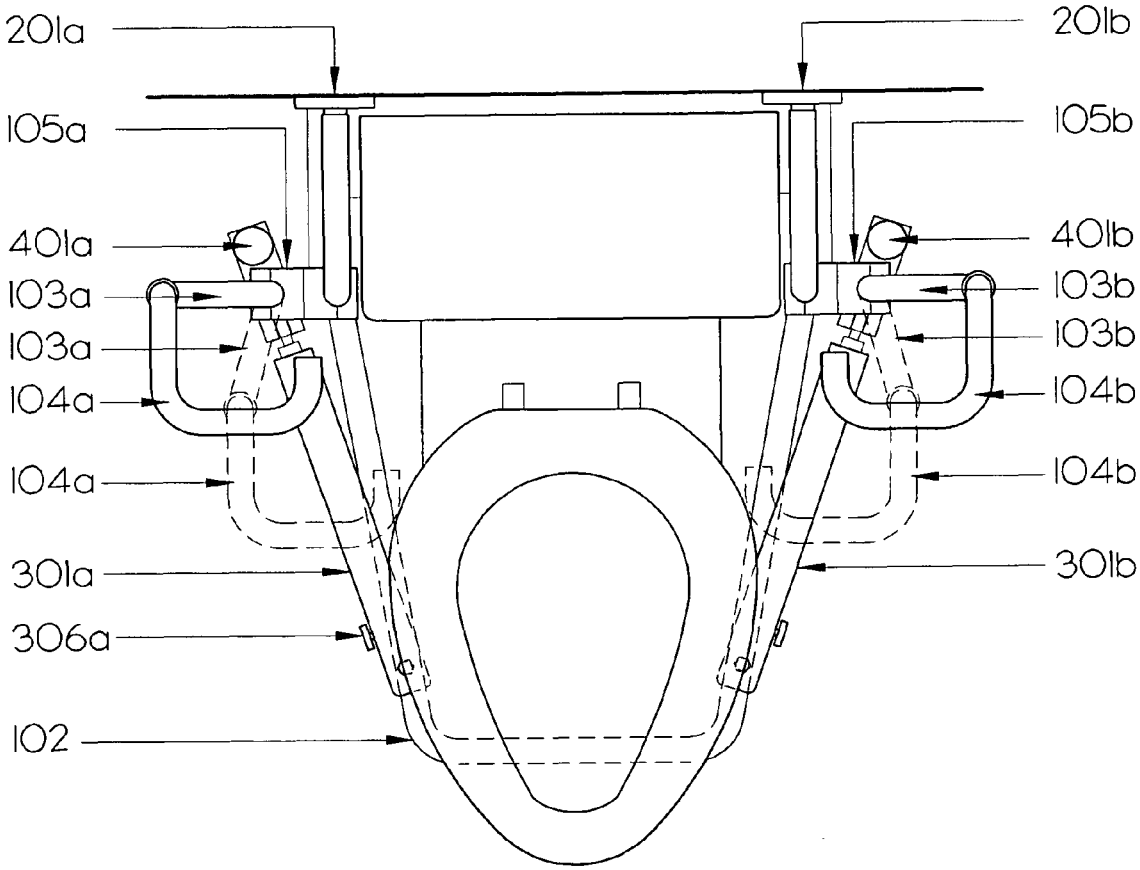
FIG. 1 is a top, plan view of the exercise machine according to the invention, in a configuration designed to fit around a toilet seat.

In the description herein for embodiments of the present invention, numerous specific details are provided, such as examples of components and/or mechanisms, to provide a thorough understanding of embodiments of the present invention. One skilled in the relevant art will recognize, however, that an embodiment of the present invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Embodiments of the present invention relate to an exercising apparatus designed to fit around a seat. Various embodiments of the invention provide an exercising apparatus that includes a frame, one or more arms and one or more resistance devices. The frame is secured to a support. The frame has a U-shaped configuration to receive a seat into the frame. The arms are pivotally coupled to the frame at one or more pivots. A pivotal motion is provided to each of the arms about the pivots with the frame, when a user exerts a directional force on the arms. The resistance devices are coupled to the frame and the arms and provide resistance to the pivotal motion. Retraction devices return the arms to their initial positions after they have been moved by the user.

Reference will now be made in detail to several embodiments of the invention that are illustrated in the accompanying drawings. Wherever feasible and convenient, same reference numerals are used in the figures and the description to refer to the same or like parts. The drawings are in a simplified form and not to scale. For purposes of convenience and clarity only, directional terms, such as top, bottom, left, right, up, down, over, above, below, beneath, rear, and front may be used with respect to the drawings. These and similar directional terms should not be strictly construed to limit the scope of the invention. In addition, words such as couple, connect, and similar terms with their inflectional morphemes are used interchangeably, unless the difference is noted or made otherwise clear from the context. These words and expressions do not necessarily signify direct connections, but include connections through mediate components and devices.

Figure 2:
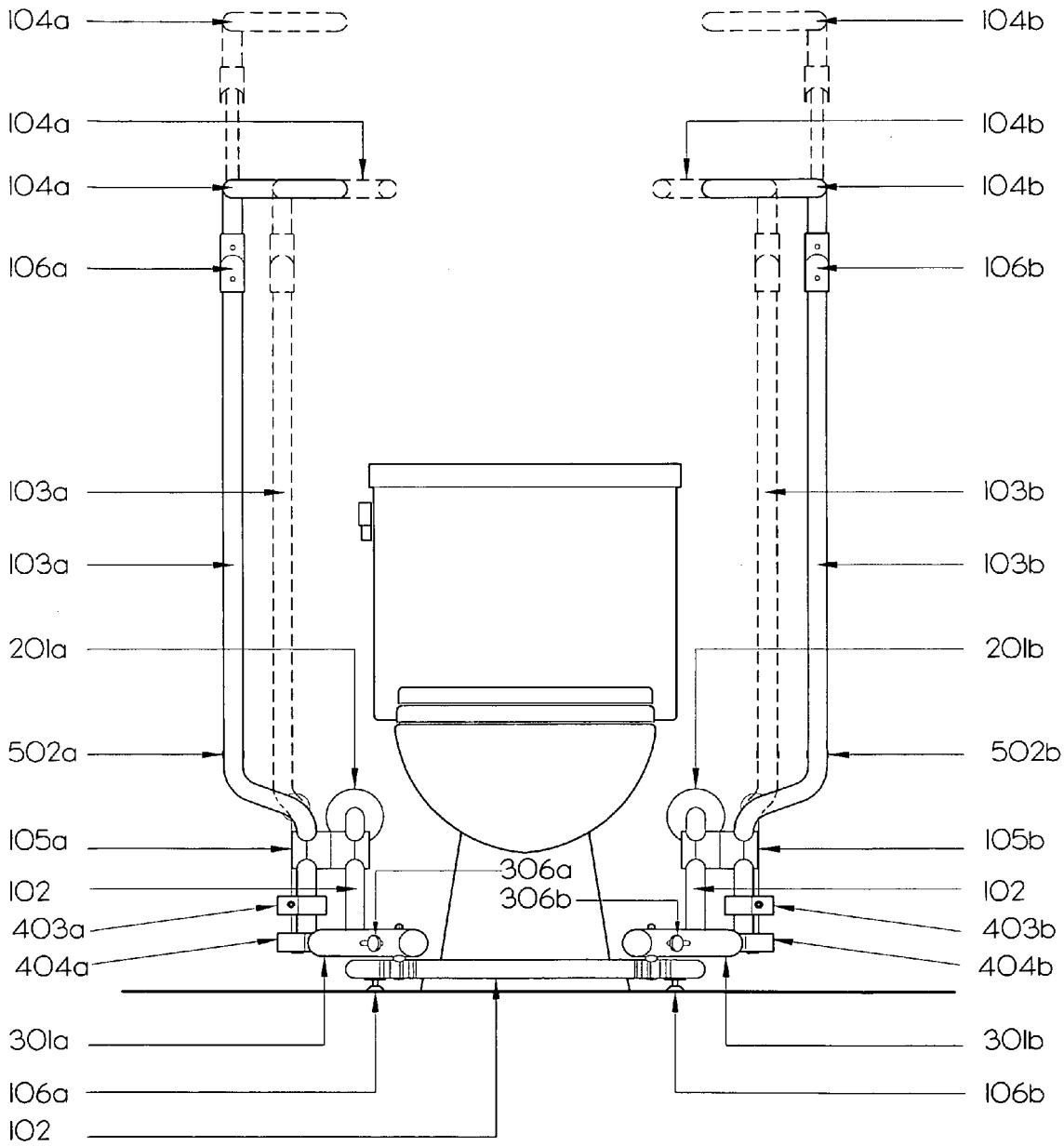
FIG. 2 is a front view of the exercise apparatus of FIG. 1.
Figure 3:
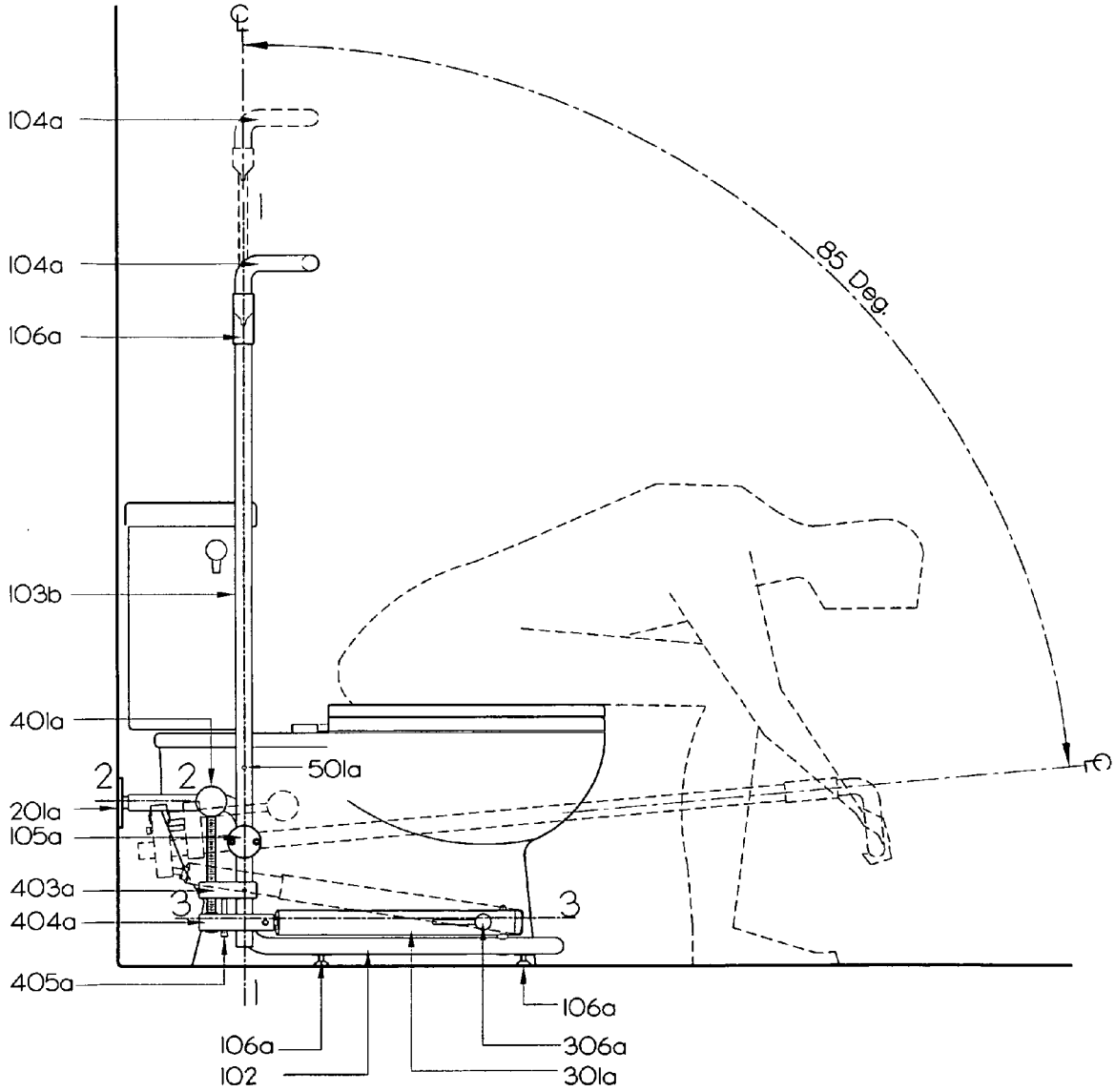
FIG. 3 is a side view of the exercise apparatus of FIG. 1.
Figure 4:
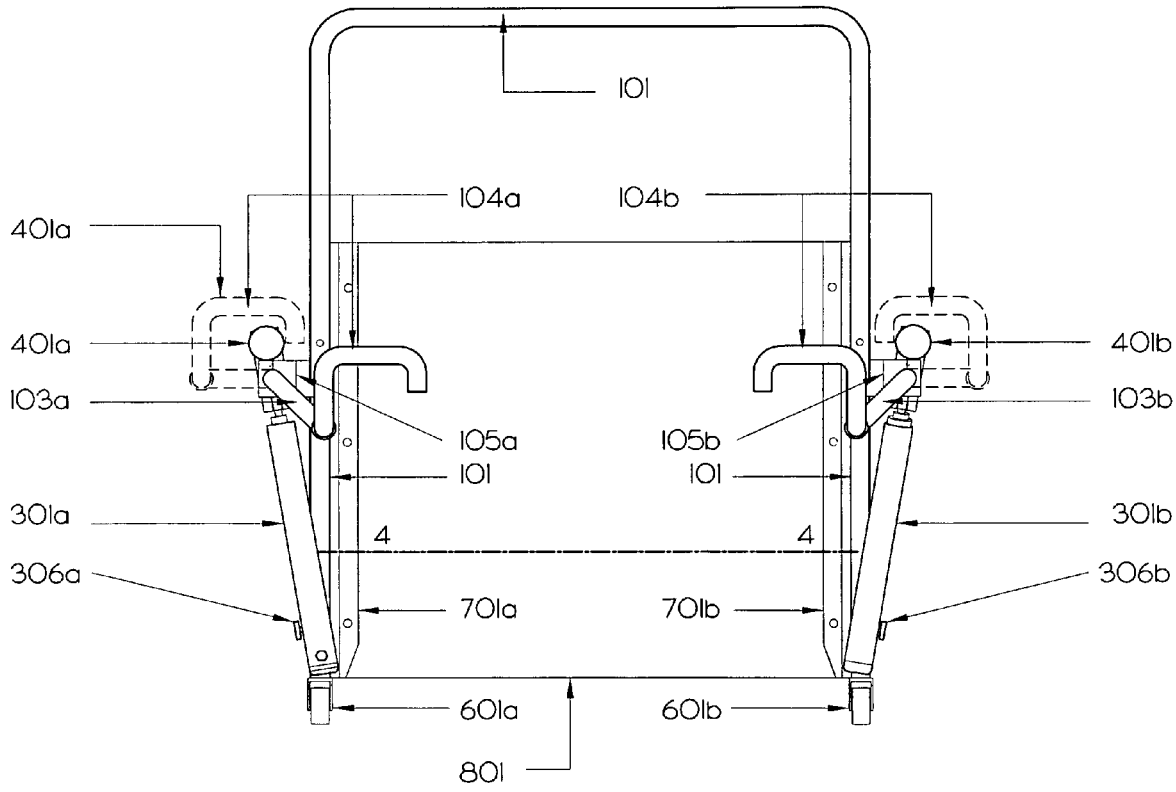
FIG. 4 is a top plan view of exercise apparatus in a configuration design to fit around a wheelchair.
Figure 5:
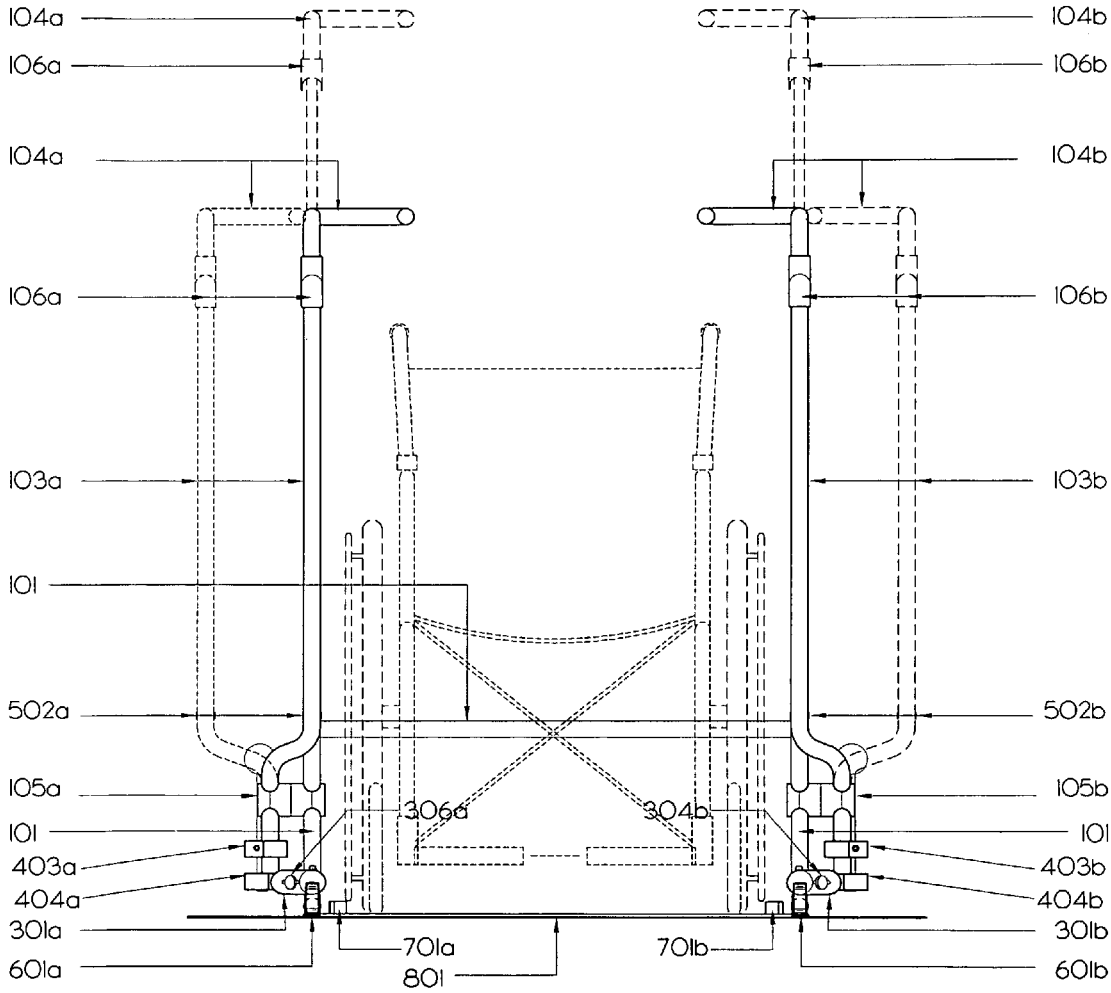
FIG. 5 is a front view of the exercise apparatus of FIG. 4.

FIGS. 1-3 illustrate the configuration of the exercise apparatus designed to fit around a toilet seat and be operated by a user while sitting on this seat. FIGS. 4-8 show the configuration of the exercise apparatus designed to be operated by a person while sitting in a wheelchair. The two configurations are similar in many respects and, in particular, they are similar with respect to the aspects, features and mechanisms to which the present invention relates.

Figure 10:
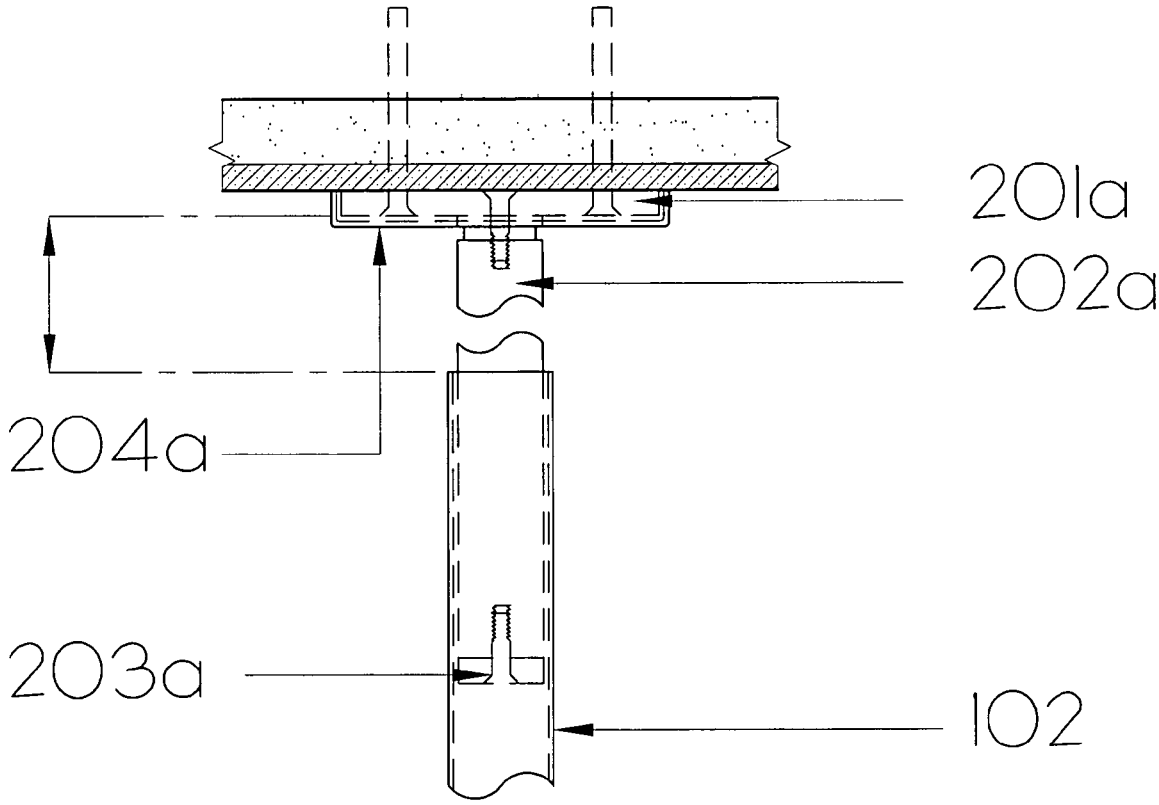
FIG. 10 is a detailed view showing how the exercise apparatus of FIG. 1 may be adjustably mounted to a wall behind a toilet seat.

Generally, the first configuration shown in FIGS. 1-3 comprises a frame 102 adapted to surround a toilet and be attached to a wall by brackets 201*a* and 201*b* directly behind the toilet. The brackets can be adjustable, for example, in the manner shown in FIG. 10. In this arrangement, a tubular member 202*a* is fitted within the frame tube 102 and is adjustably fixed therein by an expansion joint 203*a*. The opposite end of the tube 202*a* is attached to the bracket 204*a* which, in turn, is attached to the wall.

Returning to FIGS. 1-3, it may be seen that the exercise apparatus comprises arms 103*a* and 103*b* which are pivoted with respect to a tubular portion of the frame 102 by pivot joints 105*a* and 105*b*, respectively. The structure of each pivot joint will be described below in connection with FIG. 9.

The spacing between the arms 103*a* and 103*b* may be adjusted by loosening screws 109*a* in the pivot joint and rotating the arms about their axis which passes through the pivot joints and then retightening the screws.

Handgrip members 104*a* and 104*b* are provided and, as shown in FIG. 2, can be extended upward or downward with respect to the arms 103*a* and 103*b*, respectively, in which they are coaxially inserted. This extension affords an additional mode of exercise for the user. As will be described below in connection with FIG. 9, a resistance device is provided within each arm to act against the force applied by the user to extend or retract the handgrip member.

In addition, it may be seen that the handgrip members 104*a* and 104*b* may be rotated in position either toward or away from the user. When the handgrip members are in their retracted position, as shown by solid lines in FIG. 2, they are prevented from rotating about the longitudinal axis of the arm by interlocked mating portions of the tube sections 106*a* and 106*b*.

FIG. 3 shows a piston and cylinder device 301*a* which provides resistance to the force applied by the user to the arm 103*a*. This resistance device is attached at one end to a tubular portion of the frame 102 and is attached at the opposite end to a mechanism for adjusting the distance from a control point to the pivot joint 105*a* of the arm 103*a*. The mechanism, comprising elements 401*a*, 403*a*, 404*a* and 405*a* will be described below in connection with FIG. 12.

The movement of the arm 103*a* about the pivot joint 105*a* is limited by the path of travel of the piston within the cylinder 301*a*. This path of travel, which is shown in FIG. 3 as an 85° arc from the vertical to the forward position, may be adjusted and limited by adjusting the position of a thumbscrew 306*a*. This mechanism for adjusting the limit of travel of the arm will be described in detail below in connection with FIGS. 13 and 14. Suffice it to say, at this point, that the arc of movement of the arm is limited by the piston and cylinder at both ends of its travel: from the vertical to a position away from the vertical that is selectable by the user.

Figure 6:
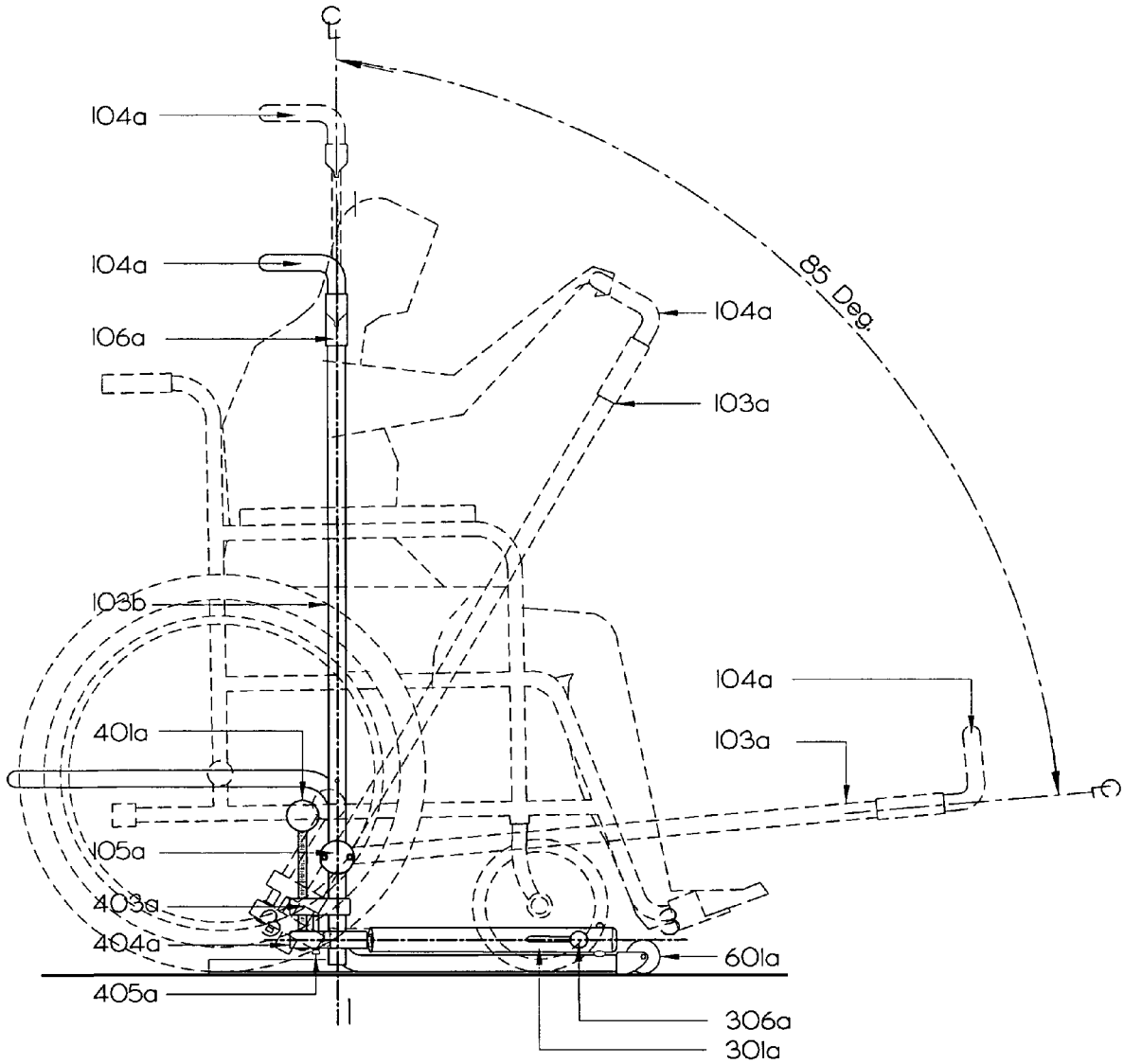
FIG. 6 is a side view of the exercise apparatus of FIG. 4.
Figure 7:
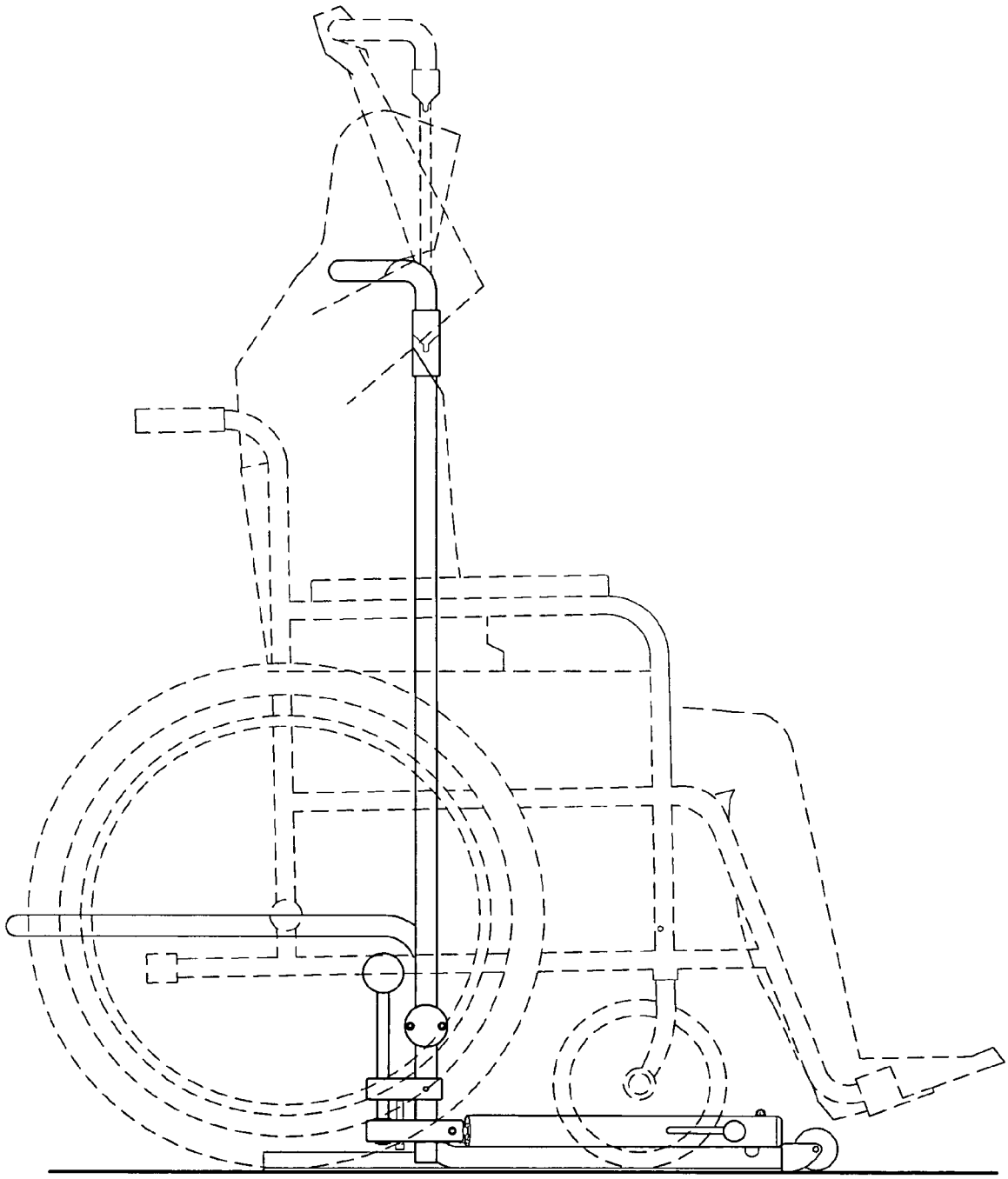
FIG. 7 is another side view of the exercise apparatus of FIG. 4, with the user in a first position.
Figure 8:
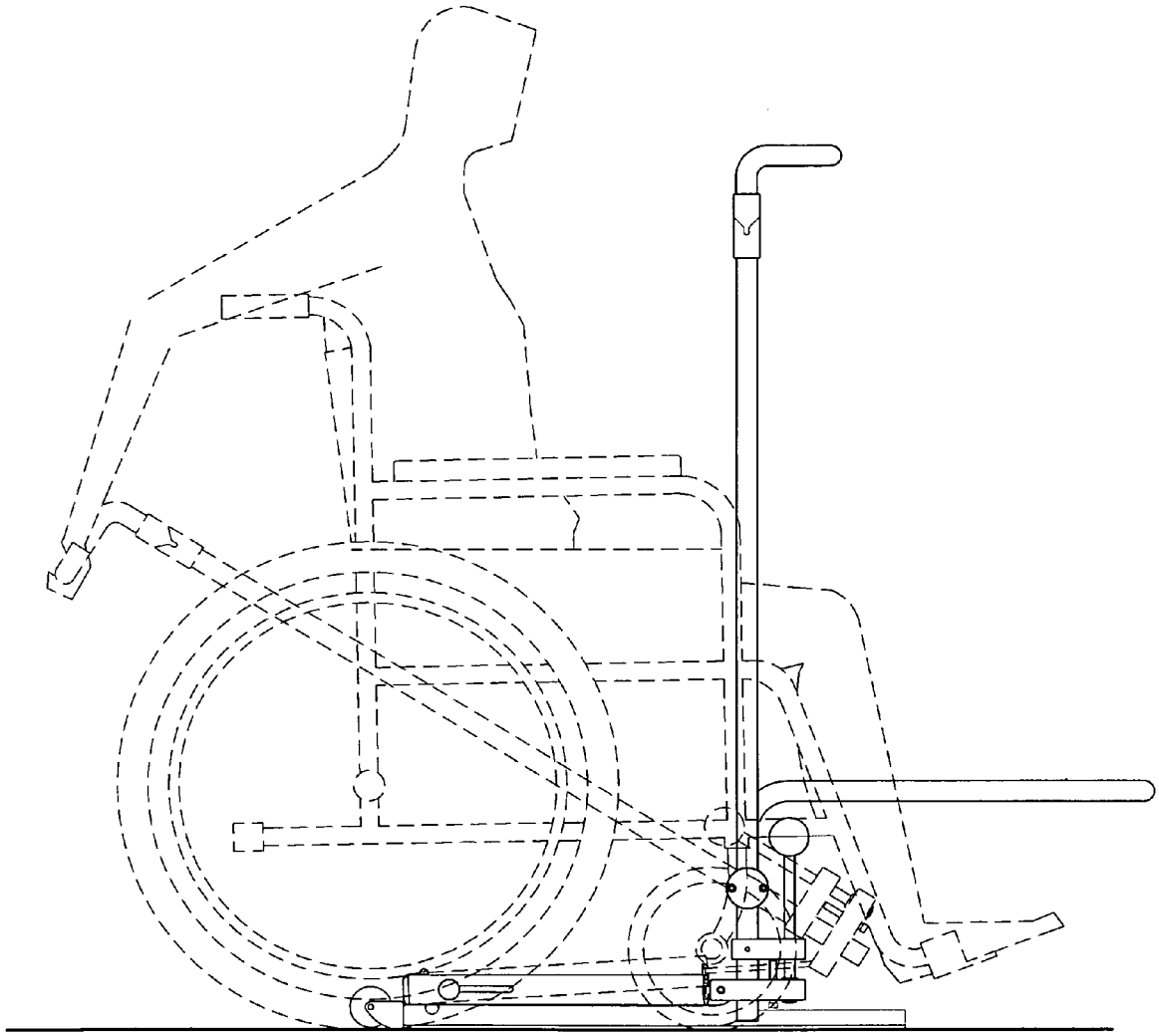
FIG. 8 is another side view of the exercise apparatus of FIG. 4, with the user in a second position, opposite in direction to the first position.

FIG. 7 shows how a user, who in this case sits in a wheelchair, may exercise by moving the arms up and down. FIG. 6 shows how the user may exercise by moving the arm 103*a* forward. FIG. 8 shows how a user may operate the exercise device with the direction of the wheelchair reversed within the apparatus.

Figure 9A:
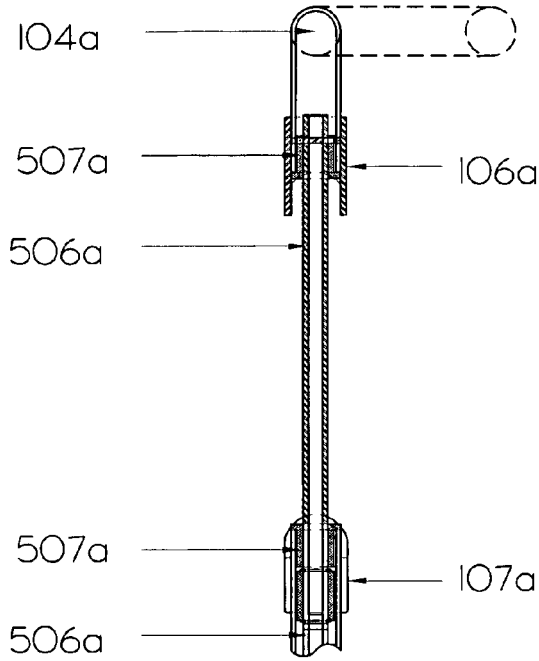
FIG. 9*a* is a detailed view of the handgrip member and its attached stem in an upwardly extended position with respect to the arm of the exercise apparatus.
Figure 9:
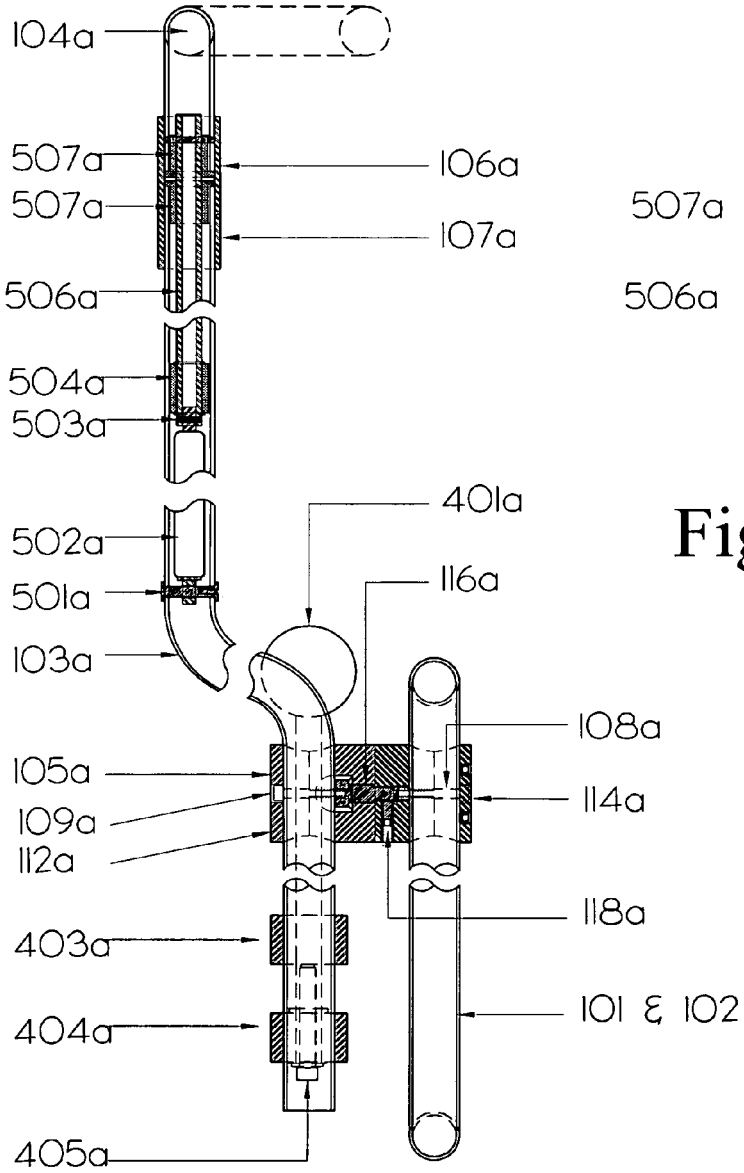
FIG. 9 is a detailed and cross-sectional view showing the pivot joint between and arm and the frame of the exercise apparatus and showing the mechanism for moving the handgrip member axially with respect to the arm to provide an additional mode of exercising.

FIGS. 9 and 9*a* illustrate with arrangement which enables the handgrip member 104*a* to move axially upward and downward (or outward and inward) with respect to the arm 103*a*. As is shown here, the downwardly extending portion of the handgrip 104*a* is connected by a sleeve 507*a* to a co-axial stem 506*a* which slides within the tube of the arm 103*a*. The stem 506*a* is maintained in alignment with the arm tube 103*a* by a Teflon coated piston 504*a* which slides within the tube 103*a*. A piston/cylinder arrangement 502*a* is connected between the arm 103*a* and the stem 506*a* of the handgrip member 104*a* by means of coupling devices 501*a* and 503*a*, respectively.

FIG. 9 also shows the structure of the pivot joint 105*a*. As is illustrated there, the pivot joint comprises a casing 105*a* having first and second openings, accommodating the tubular portions of the arm 103*a* and the frame 102, respectively. These tubular portions are held in place by set screws 108*a* and 109*a* which clamp the casing tightly about the arm and frame, respectively.

The two portions of the casing 112*a* and 114*a* are rotatable with respect to each other about a central axle formed by a screw 116*a*, fixed in position by the set screw 118*a*.

Figure 11:
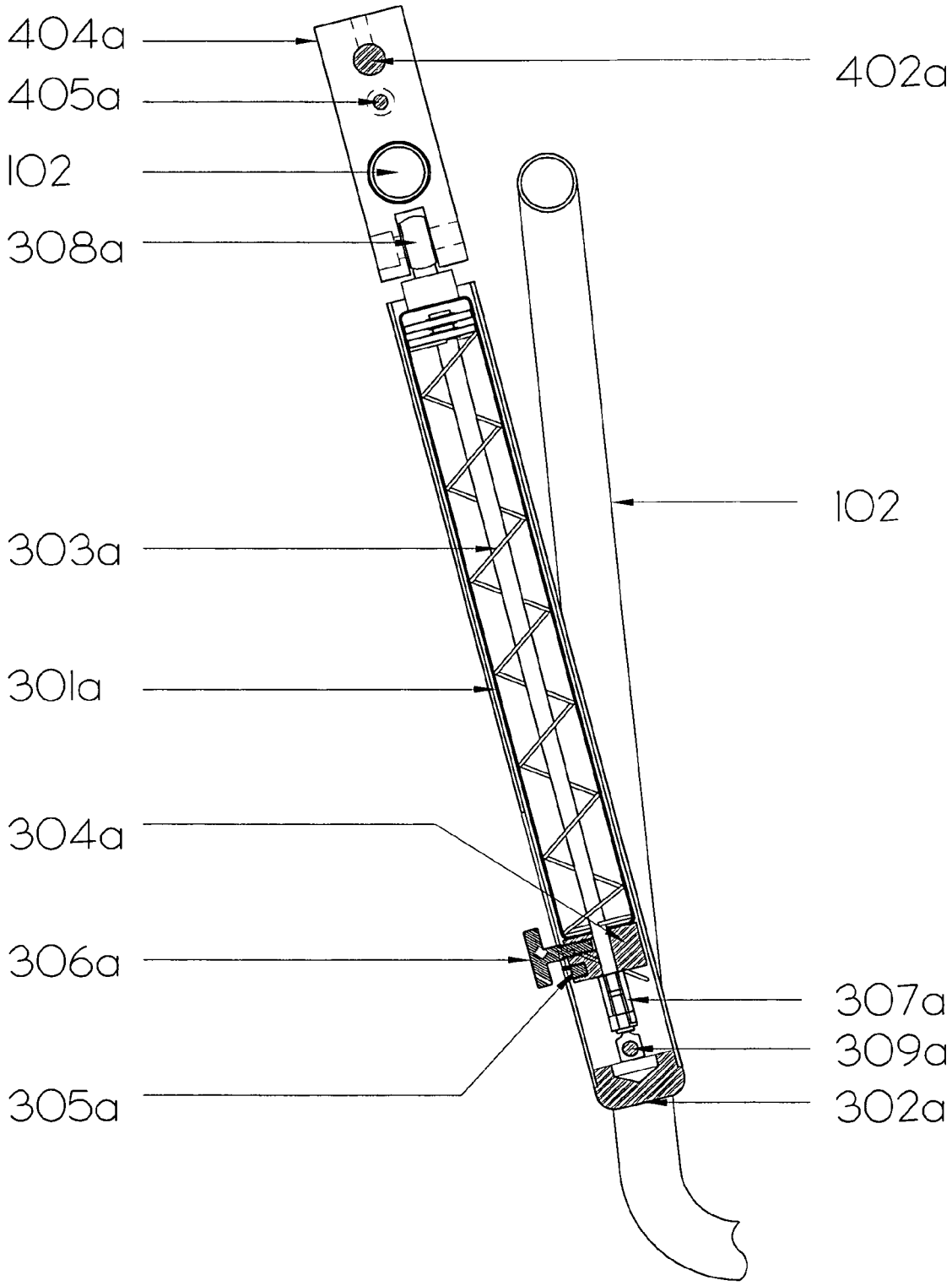
FIG. 11 is a detailed and cross-sectional view showing the resistance and retraction device for the embodiments of FIG. 1 and FIG. 4, respectively.

FIG. 11 shows the arrangement of a piston and cylinder 301*a* with an internal spring 303*a* which serves as the combined resistance and retraction device of the exercise apparatus. This device 301*a* is pivotally attached to the frame at one end 309*a* and pivotally attached to a resistance force adjusting device at its opposite end 308*a*. The oil within the cylinder flows freely past the piston when the piston travels on one direction (the retraction direction) but is partially blocked when the piston travels in the opposite direction (the resistance direction).

Motion of the piston is limited at the end of its travel within the cylinder by a locking screw 306*a*, which may be adjusted in position at the frame-connected end of the cylinder.

Figure 12:
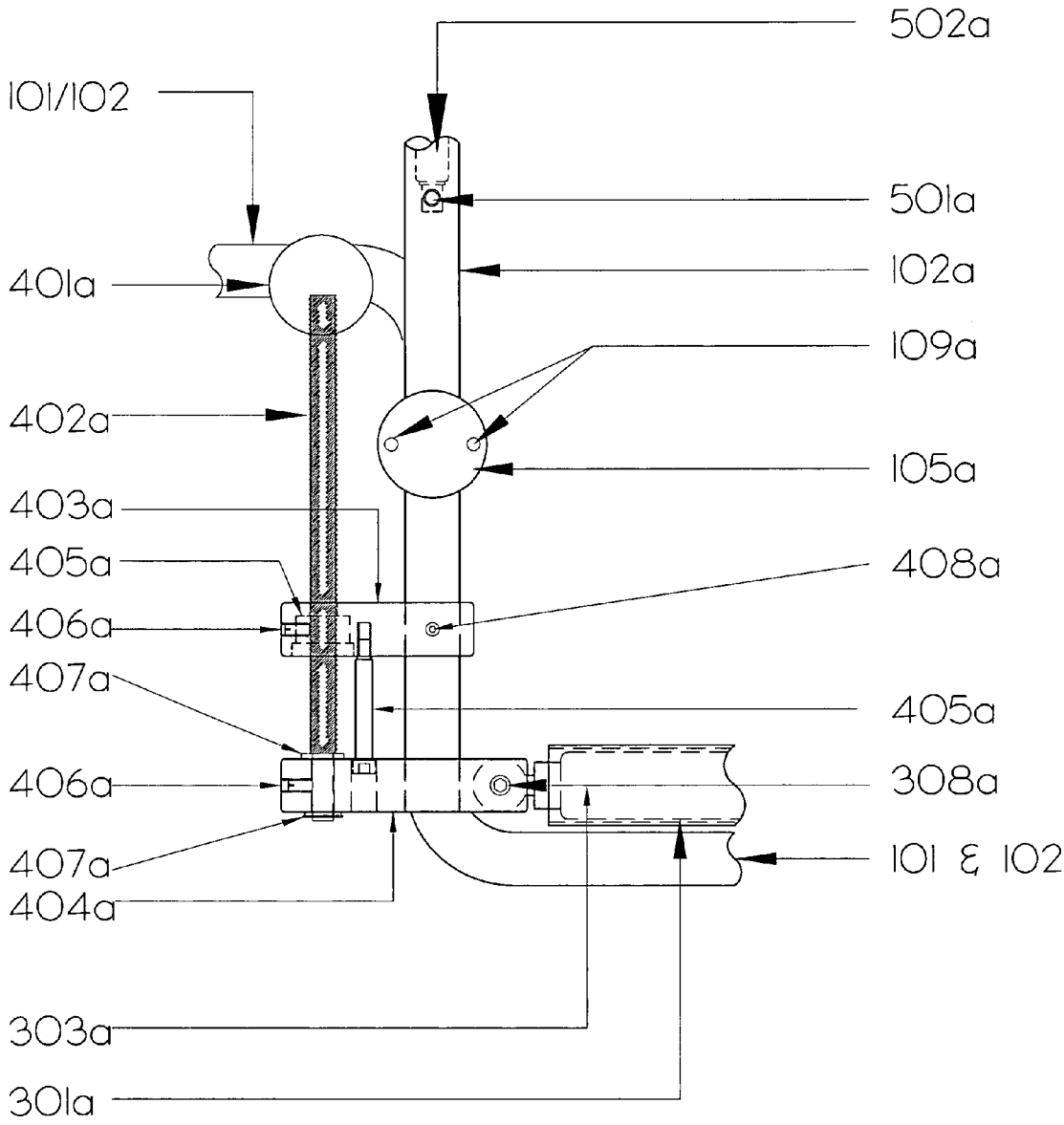
FIG. 12 is detailed view showing the mechanism for adjusting the resistance and retraction forces applied to an arm against the directional force applied by the user.

FIG. 12 shows the mechanism for adjusting the leverage of the piston and cylinder 301*a* that provides both the resistance force and retraction force applied to the arm 102*a*. This mechanism comprises two parallel bars 403*a* and 404*a* which are pivoted with respect to the arm 102*a* and the cylinder 301*a* at points 408*a* and 308*a*, respectively. The bars are maintained in parallel relationship by a pin 405*a* and a threaded bolt 402*a* having a knob 401*a* at the top. The pin 405*a* is rigidly connected to the upper bar 403*a* but slides in an opening within the lower bar 404*a*. The bolt 402*a* has a mating screw thread with the upper bar 405*a*, and is rotatably retained by flanges 407*a* in an opening in the lower bar 404*a*. When the knob 401*a* is rotated, turning the bolt 402*a*, the distance between the upper and lower bars is either increased or reduced, depending upon the direction of rotation. Since the upper bar is fixed with respect to the arm at the pivot point 408*a*, such knob rotation changes the distance of the lower bar 404*a* from the pivot joint 105*a*, thus changing the length of the lever arm of the piston/cylinder 301*a*.

Figure 13:
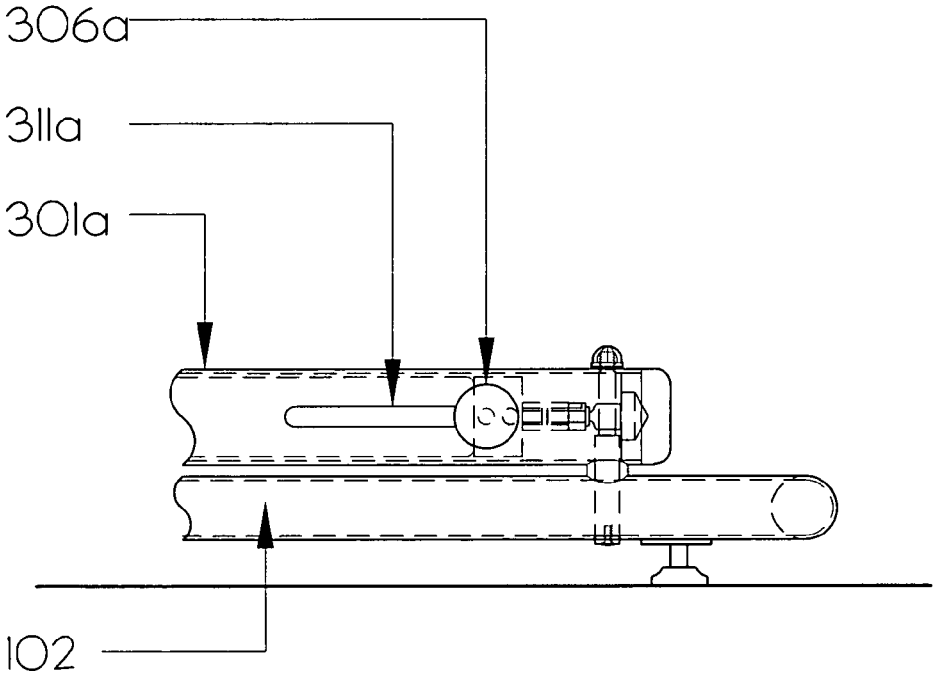
FIGS. 13 and 14 are detailed views showing a locking mechanism for limiting the range of motion of an arm of the exercise apparatus of FIGS. 1 and 4.
Figure 14:
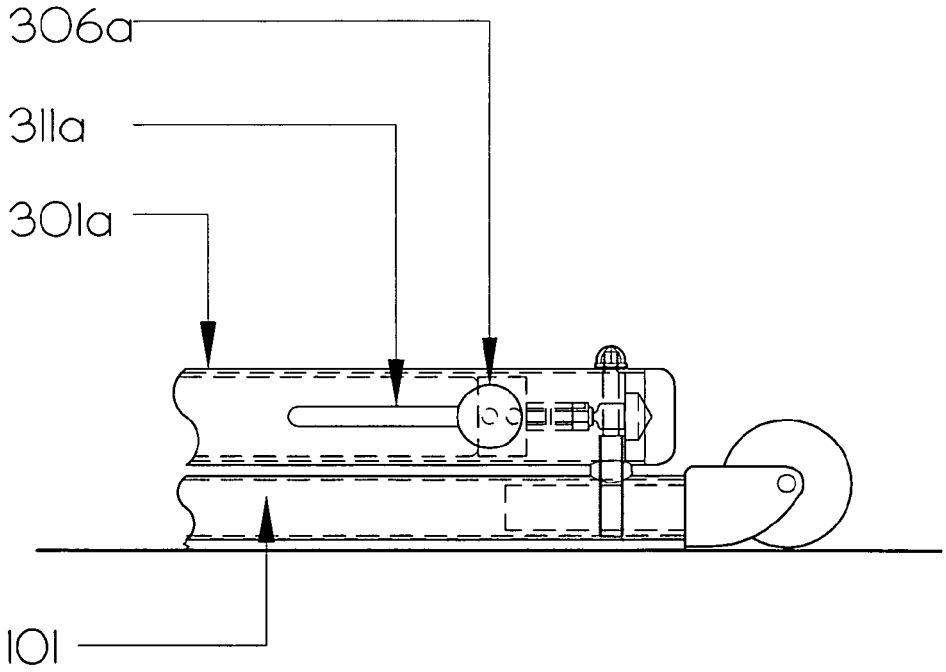

FIGS. 13 and 14 show in detail the locking mechanism for limiting range of arm movement in the first embodiment (FIG. 13) and second embodiment (FIG. 14), respectively. As explained previously in connection with FIG. 11, the locking screw 306*a* may be moved either to the right or to the left along a slot 311*a* and set to limit the end travel of the piston, thus limiting the end travel of the arm 103*a*.

Figure 15A:
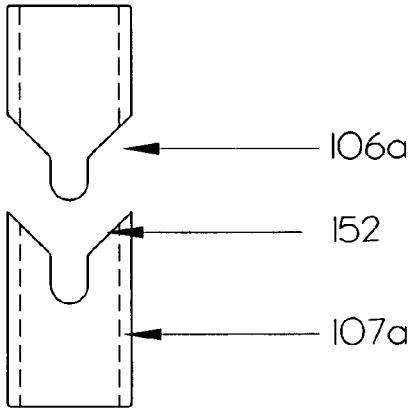
FIGS. 15*a* and 15*b* are side and front views, respectively, of two tubular members for locking the handgrip member in one of two angular positions with respect to the arm to which it is attached.
Figure 15B:
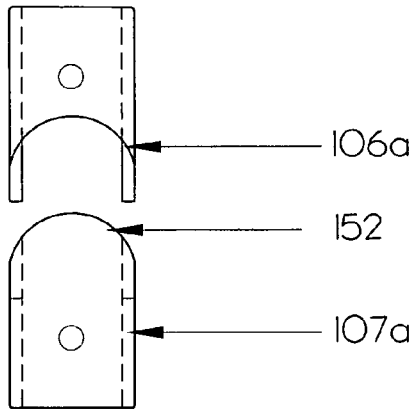
Figure 15C:
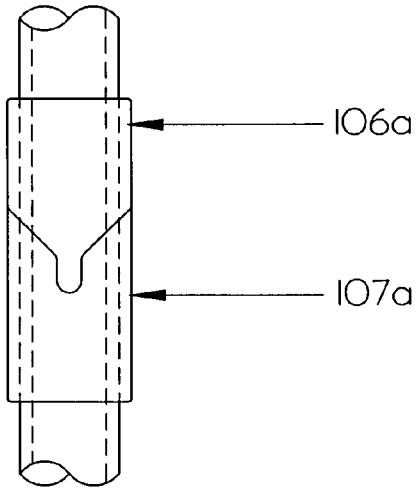
FIGS. 15*c* and 15*d* are side and front views, respectively, of the handgrip position lock with the two tubular members in mating position.
Figure 15D:
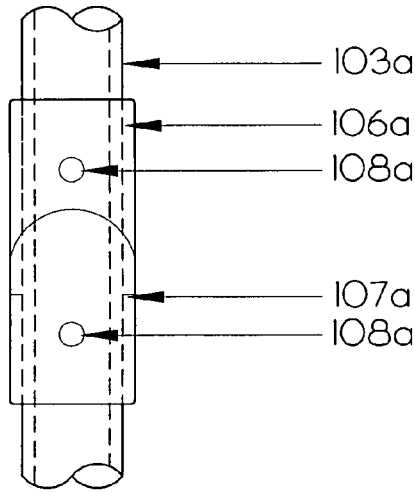

Finally, FIGS. 15*a*-15*d* show the mating surfaces of the upper and lower tubes 106*a* and 107*a*, respectively, which constrain the angular position of the handgrip member. FIGS. 15*a* and 15*b* show the parts as separate, whereas FIGS. 15*c* and 15*d* show the parts in mating relationship. As indicated in FIG. 15*d*, the tubes are fastened to the arm and handgrip member, respectively, by pins 108*a*.

Figure 15E:
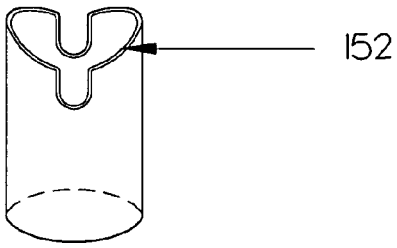
FIG. 15*e* is an isometric view of the lower tubular member shown in FIGS. 15*a*-15*d*.

FIG. 15*e* shows the lower tube 107*a* in isometric view, making visible the mating surface 152 (also identified in FIGS. 15*a* and 15*b*, respectively). The mating surface 152 of the tube member 107*a* has a vertical slot which prevents the handgrip member from rotating when the upper tube member 106*a* is in mating relationship with this lower tube member. This constrains the handgrip member to be either in one of two angular positions which are separated by 180° with respect to each other.

There has thus been shown and described a novel exercising apparatus which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. An exercising apparatus designed to fit around a seat, comprising in combination:

(a) a frame adapted to fit around said seat;

(b) an elongate arm pivotally coupled to said frame at a pivot point, said arm being movable about the pivot point in pivotal motion from a first position to a second position based on a force exerted by a user;

(c) a resistance device, coupled to said frame and to said arm, which provides a resistance force against said pivotal motion of said arm by the user in a first direction; and (d) a retracting device, coupled to said frame and to said arm, which provides a retraction force to said pivotal motion of said arm in a second direction, opposite to said first direction, wherein said arm includes first and second ends, the arm being pivotable around the pivot point between said ends, the arm being adapted to be gripped by a user near the first end; and wherein the resistance device is coupled with the arm at a control point near the second end, said apparatus further comprising means for adjusting the position of the control point, so as to be spaced closer to, or farther away from, the pivot point, whereby an amount of resistance applied to the arm is adjusted.

2. The exercising apparatus defined in claim 1, wherein the adjusting means comprises:

a first member coupled with the resistance device;

a second member coupled with the arm; and an adjuster for adjusting a distance between the first and second members.

3. The exercising apparatus defined in claim 2, wherein the adjuster comprises a threaded member coupling the first and second members and a knob for turning the threaded member.

4. The exercising apparatus of claim 3, wherein the first member and the second member are elongate members arranged, and constrained to be, in parallel and wherein said threaded member moves one of said first and second members toward or away from the other.

5. The exercising apparatus of claim 1, wherein one each of said elongate arm, said resistance device and said adjusting means are disposed on opposite sides of said frame.

6. The exercising apparatus of claim 1, wherein the apparatus is adapted to accommodate a seated user and the arm pivots in such a way as to allow the user to push it forward and pull it back when sitting on the seat.

7. The exercising apparatus of claim 1, wherein the resistance device comprises a piston and cylinder.

8. The exercising apparatus of claim 1, wherein the retracting device comprises a spring.

9. The exercising apparatus of claim 1, wherein the resistance device comprises a piston and cylinder and the retracting device comprises a spring arranged within the cylinder.

10. An exercising apparatus designed to fit around a seat, comprising in combination:

(a) a frame adapted to fit around said seat;

(b) an elongate arm pivotally coupled to said frame at a pivot point, said arm being movable about the pivot point in pivotal motion from a first position to a second position based on a force exerted by a user; and (c) a resistance device, coupled to said frame and to said arm, which provides a resistance force against said pivotal motion of said arm by the user in a first direction, wherein said arm includes first and second ends, the arm being pivotable around the pivot point between said ends, the arm being adapted to be gripped by a user near the first end; and wherein the resistance device is coupled with the arm at a control point near the second end, said apparatus further comprising a locking mechanism for limiting the range of motion of the arm about the pivot.

11. The exercising device of claim 10, further comprising a retracting device, coupled to said frame and to said arm, which provides a retraction force to said pivotal motion of said arm in a second direction, opposite to said first direction.

12. The exercising apparatus of claim 10, wherein the locking mechanism is adjustable and comprises means for selecting one of at least a first and a second locking location, for constraining the arm into one of at least a first and a second range of motion, respectively.

13. The exercising apparatus of claim 12, wherein the adjustable locking mechanism constrains one end of the range of motion of said arm.

14. The exercising apparatus of claim 12, wherein the adjustable locking mechanism constrains both ends of the range of motion of said arm.

15. The exercising apparatus of claim 10, wherein the apparatus is adapted to accommodate a seated user; the arm pivots in such a way as to allow the user to push it forward and pull it back when sitting on the seat; and the range of motion constrains the arm to move between a substantially vertical position and a position near the limit of the user's mobility away from the vertical.

16. The exercising apparatus of claim 10, wherein the apparatus is adapted to accommodate a seated user;

the arm pivots in such a way as to allow the user to push it forward and pull it back when sitting on the seat; and the range of motion constrains the arm to move between two non-vertical positions near the limit of the user's non-vertical mobility in either direction.

17. The exercising apparatus of claim 10, wherein the resistance device comprises a cylinder with an internal piston, and wherein the locking mechanism comprises a device, attached to the cylinder, for limiting motion of the piston within the cylinder.

18. The exercising apparatus of claim 11, wherein the retracting device comprises a spring.

19. The exercising apparatus of claim 11, wherein the resistance device comprises a piston and cylinder and the retracting device comprises a spring arranged within the cylinder.

20. An exercising apparatus designed to fit around a seat, comprising in combination:

(a) a frame adapted to fit around said seat;

(b) an elongate arm pivotally coupled to said frame at a pivot point, said arm being movable about the pivot point in pivotal motion from a first position to a second position based on a force exerted by a user; and (c) a first resistance device, coupled to said frame and to said arm, which provides a resistance force against said pivotal motion of said arm by the user in a first direction;

wherein said arm includes first and second ends, the arm being pivotable around the pivot point between said ends, the arm having a handgrip member at the first end which is adapted to be gripped by a user;

wherein the first resistance device is coupled with the arm at a control point near the second end;

the apparatus further comprising at least one locking mechanism adapted to lock the handgrip member in one of at least first and second positions with respect to the arm.

21. The exercising apparatus of claim 20, wherein the handgrip member extends outward at an angle with respect to a longitudinal axis of the arm and the first and second positions correspond to angular positions of rotation about the longitudinal axis.

22. The exercising apparatus of claim 21, wherein the first position is on a first side of the arm closer to an expected user position; and the second position is on a second side of the arm farther from the expected user position.

23. The exercising apparatus of claim 22, wherein one each of said elongate arm and said resistance device are disposed on opposite sides of said frame, and wherein when both handgrip members are in their respective first positions the space between the handgrips is at a first distance, and when both handgrip members are in their respective second positions the space between the handgrips is at a second distance, said second distance being greater than said first distance.

24. The exercising apparatus of claim 23, wherein the second distance is sufficient to allow use by an obese or broad shouldered person between the handgrip members, whereas the first distance is sufficient to allow use by a user of average shoulder width.

25. The exercising apparatus of claim 20, wherein the arm comprises a first tubular member;

the handgrip member comprises a second tubular member having a portion inserted within and movable with respect to the first tubular member; and the locking mechanism comprises third and fourth tubular members, the third tubular member being disposed around the first tubular member and the fourth tubular member being disposed around the second tubular member, the third and fourth tubular members having mating surfaces for engaging one another and limiting movement of the second tubular member into the first tubular member.

26. The exercising apparatus of claim 25, wherein the mating surfaces define at least first and second relative positions between the first and second tubular members, the first relative position being with the mating surfaces mated and the second relative position being rotated 180° about the common longitudinal axis with respect to the first relative position, so that respective ends of the third and fourth tubular portions are in mating contact with one another.

27. The exercising apparatus of claim 26, wherein the end of the third tubular member has a slotted portion in its respective mating surface, and the end of the fourth tubular member has a nose in its respective mating portion which rests in said slotted portion and prevents relative rotation about their common axis when in mating relationship.

28. The exercising apparatus of claim 25, wherein the second tubular member forming said handgrip member is disposed at an angle with respect to the first tubular member and the first and second relative positions define first and second handgrip positions, respectively.

29. The exercising apparatus of claim 28, wherein one of the first and second handgrip positions is at a user side of the arm and the other of the first and second handgrip positions is at a side of the arm away from the user.

30. The exercising apparatus of claim 20, further comprising a retracting device, attached to said frame and to said arm, which provides a retraction force to said pivotal motion of said arm in a second direction, opposite to said first direction.

31. The exercising apparatus of claim 20, wherein the arm comprises a first tubular member; and the handgrip member comprises a second tubular member having a portion inserted within and movable with respect to the first tubular member, wherein the locking mechanism comprises means for locking the angular position of the first tubular member with respect to the second tubular member about their common longitudinal axis.

32. The exercising apparatus of claim 31, wherein the first tubular member has first straight portion with a first longitudinal axis at one end and a second straight portion with a second longitudinal axis, substantially parallel to said first longitudinal axis, at its opposite end, said first tubular member having a transition section between said first and second straight portions.

33. The exercising apparatus of claim 32, wherein said first tubular member is rotatable about said second longitudinal axis to select the relative position of said first straight portion with respect to the second straight portion.

34. The exercising apparatus of claim 20, wherein the arm comprises a first tubular member; and the handgrip member comprises a second tubular member having a portion inserted within and movable longitudinally with respect to the first tubular member about their common longitudinal axis, the apparatus further comprising a second resistance device, coupled to said first and second tubular members, which provides a resistance force against the longitudinal motion of said first tubular member with respect to said second tubular member by the user.

35. The exercising apparatus of claim 34, wherein said resistance means is a piston and cylinder disposed within at least one of said first and second tubular members.

36. The exercising apparatus of claim 35, further comprising a retraction spring disposed within said cylinder for biasing the handgrip member toward the arm.

37. The exercising apparatus of claim 35, wherein the locking mechanism comprises means for locking the respective longitudinal positions of the first and second tubular members along their common longitudinal axis.

38. The exercising apparatus of claim 1, further comprising a casing defining first and second openings for accommodating tubular portions of said arm and said frame, respectively, the first opening being in a first portion of the casing and the second opening being in a second portion of the casing; and a rotating joint disposed between the first and second portions of the casing and allowing relative rotation therebetween.

39. The exercising apparatus of claim 38, wherein the rotating joint comprises an axle aligned with and extending between the tubular portions of the arm and frame, but intersecting neither.

40. The exercising apparatus of claim 10, further comprising a casing defining first and second openings for accommodating tubular portions of said arm and said frame, respectively, the first opening being in a first portion of the casing and the second opening being in a second portion of the casing; and a rotating joint disposed between the first and second portions of the casing and allowing relative rotation therebetween.

41. The exercising apparatus of claim 40, wherein the rotating joint comprises an axle aligned with and extending between the tubular portions of the arm and frame, but intersecting neither.

42. The exercising apparatus of claim 20, further comprising a casing defining first and second openings for accommodating tubular portions of said arm and said frame, respectively, the first opening being in a first portion of the casing and the second opening being in a second portion of the casing; and a rotating joint disposed between the first and second portions of the casing and allowing relative rotation therebetween.

43. The exercising apparatus of claim 42, wherein the rotating joint comprises an axle aligned with and extending between the tubular portions of the arm and frame, but intersecting neither.

44. An exercising apparatus designed to fit around a seat, comprising in combination:

(a) a frame adapted to fit around said seat;

(b) an elongate arm pivotally coupled to said frame at a pivot point, said arm being movable about the pivot point in pivotal motion from a first position to a second position based on a force exerted by a user; and (c) a resistance device, coupled to said frame and to said arm, which provides a resistance force against said pivotal motion of said arm by the user in a first direction, wherein said arm includes first and second ends, the arm being pivotable around the pivot point between said ends, the arm being adapted to be gripped by a user near the first end; and wherein the resistance device is coupled with the arm at a control point near the second end, said apparatus further comprising means for adjusting the position of the control point between said second end and said pivot point, so as to be spaced closer to, or farther away from, the pivot point, whereby an amount of resistance applied to the arm can be adjusted by a patient sitting in the seat.

45. The exercising apparatus of claim 44, wherein a first member is operatively connected to the resistance device; a second member, disposed at a distance from the first member, is operatively connected to the arm; and a threaded adjuster extends from the first member to the second member so that rotation of the adjuster adjusts the distance between the first and the second members.

46. The exercising apparatus of claim 45, wherein the adjuster has an upwardly extending end that has a knob or handle fixedly attached thereto.

47. The exercising apparatus of claim 44 which further comprises a retracting device coupled to said frame and to said arm, which provides a retraction force to said pivotal motion of said arm in a second direction, opposite to said first direction.

48. An exercising apparatus designed to fit around a seat, comprising in combination:

(a) a frame adapted to fit around said seat;

(b) an elongate arm pivotally coupled to said frame at a pivot point, said arm being movable about the pivot point in pivotal motion from a first position to a second position based on a force exerted by a user;

(c) a resistance device, coupled to said frame and to said arm, which provides a resistance force against said pivotal motion of said arm by the user in a first direction; and (d) a retracting device, coupled to said frame and to said arm, which provides a retraction force to said pivotal motion of said arm in a second direction, opposite to said first direction, wherein said arm includes first and second ends, the arm being pivotable around the pivot point between said ends, the arm being adapted to be gripped by a user near the first end; and wherein the resistance device is coupled with the arm at a control point near the second end.

49. An exercising apparatus designed to fit around a seat, comprising in combination:

(a) a frame adapted to fit around said seat;

(b) an elongate arm pivotally coupled to said frame at a pivot point, said arm being movable about the pivot point in pivotal motion from a first position to a second position based on a force exerted by a user; and (c) a first resistance device, coupled to said frame and to said arm, which provides a resistance force against said pivotal motion of said arm by the user in a first direction;

wherein said arm includes first and second ends, the arm being pivotable around the pivot point between said ends, the arm having a handgrip member at the first end which is adapted to be gripped by a user;

wherein the first resistance device is coupled with the arm at a control point near the second end;

wherein the arm comprises a first tubular member; and wherein the handgrip member comprises a second tubular member having a portion inserted within and movable longitudinally with respect to the first tubular member about their common longitudinal axis, the apparatus further comprising a second resistance device, coupled to said first and second tubular members, which provides a resistance force against the longitudinal motion of said first tubular member with respect to said second tubular member by the user.

50. The exercising apparatus of claim 49, wherein the apparatus further comprising at least one locking mechanism adapted to lock the handgrip member in one of at least first and second positions with respect to the arm.

* * * * *